United States Patent [19]

Phillips

[11] 4,315,809

[45] Feb. 16, 1982

[54] CLUSTER CORE ASSEMBLY FOR ELECTROPLATING RADIOACTIVE SOURCES FOR AN IONIZATION SMOKE DETECTOR

[75] Inventor: James G. Phillips, Albuquerque, N. Mex.

[73] Assignee: Honeywell Inc., Minneapolis, Minn.

[21] Appl. No.: 32,042

[22] Filed: Apr. 23, 1979

[51] Int. Cl.[3] ..... C25D 17/00

[52] U.S. Cl. ..... 204/224 R

[58] Field of Search ..... 204/224 R

[56] References Cited

U.S. PATENT DOCUMENTS

| | | | |
|---|---|---|---|
| 2,479,882 | 8/1949 | Wallhausen | 250/106 |
| 3,723,283 | 3/1973 | Johnson | 204/224 R |
| 3,745,105 | 7/1973 | Kosowsky | 204/224 R |
| 3,860,499 | 1/1975 | Graham | 204/15 |
| 3,865,698 | 2/1975 | Kosowsky | 204/15 |
| 3,974,056 | 8/1976 | Jogwick | 204/207 |
| 3,977,957 | 8/1976 | Kosowsky | 204/224 R |
| 4,033,844 | 7/1977 | Pantiga | 204/224 R |
| 4,069,109 | 1/1978 | Abei | 204/15 |
| 4,163,704 | 8/1979 | Murata | 204/224 R |

FOREIGN PATENT DOCUMENTS

| | | | |
|---|---|---|---|
| 527912 | 10/1972 | Switzerland | 204/224 R |

*Primary Examiner*—T. M. Tufariello

*Attorney, Agent, or Firm*—Clyde C. Blinn

[57] ABSTRACT

Apparatus for electroplating radioactive sources on a member or substrate for use in an ionization type smoke detector device. The substrate is clamped between two members with a chamber adjacent a portion of the substrate. The chamber contains a hollow electrode which is positioned closely to the substrate so that when an electrolyte solution of radioactive material is placed in the chamber and current is passed from the electrode through the electrolyte into a grounded substrate, a deposit of radioactive material is left on the dimple in the substrate.

7 Claims, 5 Drawing Figures

CLUSTER CORE ASSEMBLY FOR ELECTROPLATING RADIOACTIVE SOURCES FOR AN IONIZATION SMOKE DETECTOR

BACKGROUND OF THE INVENTION

1. Field of the Invention

The invention is concerned with an improved apparatus for electroplating a radioactive source of material on a metal substrate which can be used in the ionization chamber of an ionization type smoke detector device.

2. Description of the Prior Art

A radioactive ionization source for an ionization type smoke detector device has heretofore been made by depositing small portions of radioactive material on a substrate and baking the deposit and then coating to provide for a radioactive source which will withstand the environmental conditions such as changes in temperature, shock, corrosion, or physical movement and the normal handling which takes place in the manufacture of a smoke detector device. Often such radioactive sources become ineffective due to their physical change, i.e. breaking, crumbling or loosening from the substrate which results in a complete failure of the smoke detector device and can result in a hazardous condition of radioactive material being free to move outside of the confined chamber of the device.

To provide the radioactive source which is relatively stable and can withstand certain physical abuse, the applicant studied the old art of electroplating material on metal by using an electrolyte and exposing the electrolyte to a voltage to have current flow to deposit material from the electrolyte on a substrate.

SUMMARY OF THE INVENTION

The present invention is concerned with an apparatus for electroplating a small deposit of radioactive material on a metal substrate. The substrate is held between two seals so that one end of a core is against the substrate whereby upon the circulation of an electrolyte into the core, the substrate surface is contacted by the electrode. An electrolyte spaced from the substrate is connected to a voltage source to provide a constant current through the electrolyte to the substrate to deposit material from the electrolyte on the substrate. After the electroplating process, the electrolyte solution is rinsed from the apparatus by passing a washing solution and then air for drying through the electrode. When the substrate is removed, a small circular deposit of radioactive material is attached thereto for use in an ionization type smoke detector device.

DESCRIPTION OF THE PREFERRED EMBODIMENT

Figure 1:
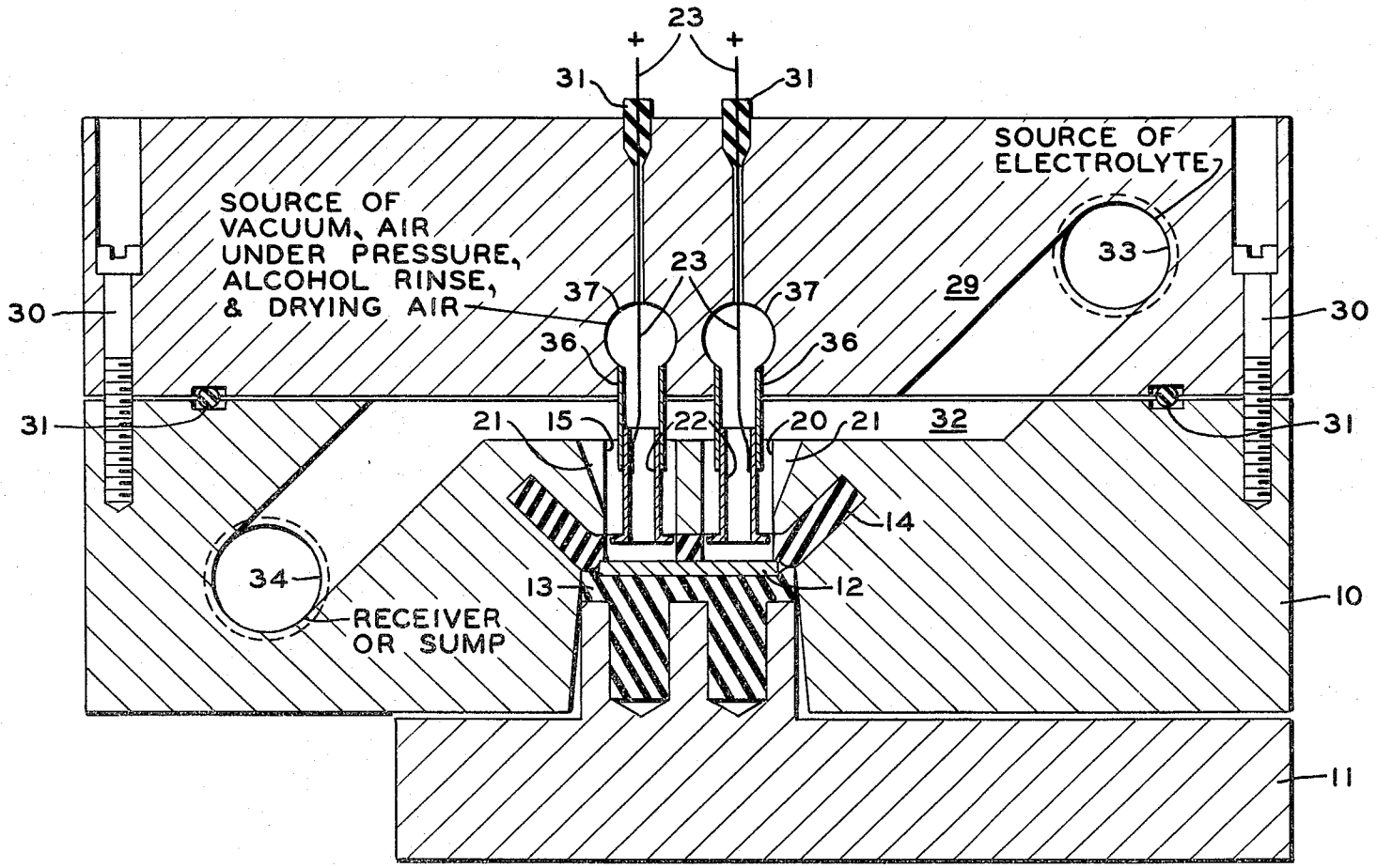
FIG. 1 is a cutaway schematic representation of the apparatus for clamping the substrate between two members and exposing a portion of the substrate to the electrolyte and electrodes for the electroplating process.

Referring to FIG. 1, a cross-sectional view of the cluster core assembly is shown having an upper or stationary member or portion 10 and a lower, movable member or portion 11. The portions are shown in the engaged position holding a sheet of material or metal member substrate 12 on which small deposits of radioactive material are to be plated for use in an ionization type smoke detector device. When the upper and lower members are together, a lower sealing member or material 13 and an upper sealing member or material 14 enclose substrate 12 so the only portion of the substrate which is exposed is that under the two chambers, cores or cavities 15 and 20 in the upper member 10.

While the cross-sectional view of FIG. 1 shows only two chambers 15 and 20, the number of chambers contained may be numerous to provide for the simultaneous plating of a number of sources at one time on the substrate 12; however, only two chambers are shown for explanation purposes. Chambers 15 and 20 have vertical grooves 21 cut around the periphery of the chamber, two of which are shown in FIG. 1 and are more apparent in FIGS. 2 and 3. The grooves provide for entrance of electrolyte and for the escapement of air from the chamber, upon the filling of the chambers 15 and 20 with electrolyte. The entrapment of air in the cores, in the form of bubbles, would prevent the electrolyte from flowing down to the bottom of the chamber to contact substrate 12.

Contained in each of the chambers 15 and 20 are round, hollow electrodes 22 which have a flared end 23 spaced away from the substrate surface 12 by a distance of approximately 50 to 100 thousands of an inch. Electrodes 22 are connected to terminals 23 which are connected to a source of constant current of approximately 3/10ths milliamperes with a voltage of 10 to 20 volts; so that, current flows into each of the terminals 23 to the substrate which is grounded.

The upper member 10 is made up of two sections 28 and 29 which are attached by screws 30 and a conventional seal 31. The electrodes 22 are connected to the + voltage source by conductors passing through section 29 and held by insulators 31. The electrolyte passage 32 which is connected to each of the chambers 15 and 20 can receive an electrolyte from a source through opening 33 to pass through the system and exit to a receiver or sump at opening 34. The electrolyte comprises a solution of alcohol, nitric acid and $AM^{241}$ nitrate. The electrodes 22 are contained in jet tubes 36 which are connected to the wash and dry manifolds 37 through which an electrolyte expelling air, a washing fluid and then air for drying can pass through the electrode.

Figure 2:
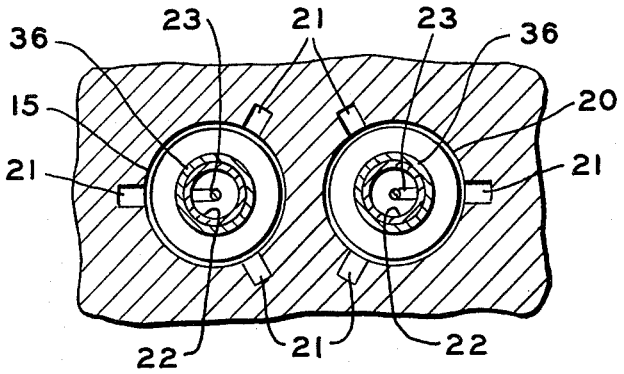
FIG. 2 is a cross-sectional view of the core assembly of FIG. 1 showing the cuts for the prevention of bubbles in the core.
Figure 3:
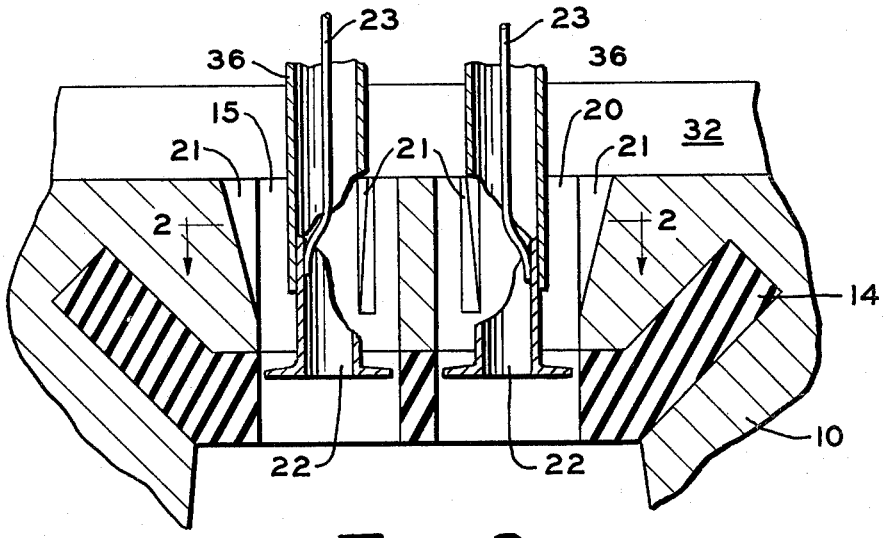
FIG. 3 is another cross-sectional view of the core assembly with one electrode mounted in a core.

FIG. 2 is a cross-sectional view of the chambers of FIG. 1 showing the grooves 21 and the electrodes 22. The electrode 22 and grooves 21 are shown in the expanded side view of FIG. 3.

Figure 4:
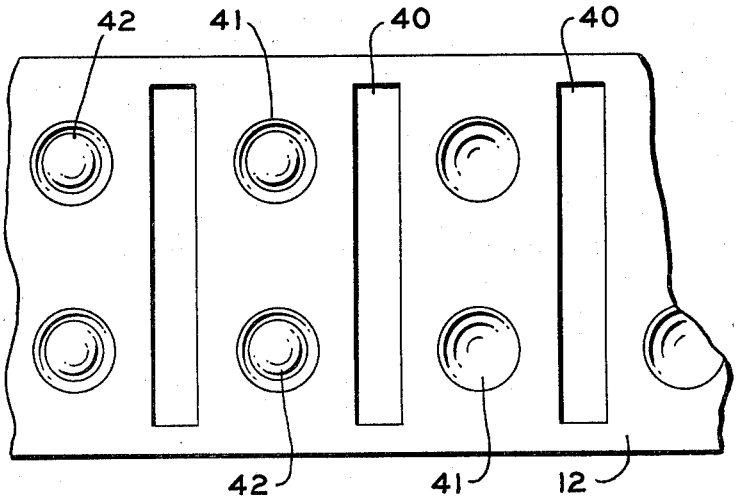
FIG. 4 is a typical substrate showing the electroplated deposits.
Figure 5:
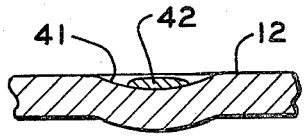
FIG. 5 is a cross-sectional view of the substrate showing one indentation and a deposit.

The member or substrate 12, as shown in FIG. 4, is cut with openings 40 for ease of breaking the substrate into individual pieces after the plating operation. The substrate has dimples 41 into which the plated source 42 is placed by the electroplating operation of the apparatus of FIG. 1 to provide the plated source on the substrate 12 as shown in FIG. 5.

OPERATION OF THE PREFERRED EMBODIMENT

Referring to FIG. 1, with member 11 moved downward away from member 10, either manually or by conventional automatic control, substrate 12, such as shown in FIG. 4, is placed between the members 10 and 11 and clamped by the movement of the lower member upward to the position as shown. In this position, the seals 13 and 14 provide the seals so that when the electrolyte enters 15 and 20 from the supply opening 33, the electroltye is contained to only engage the appropriate surface of the substrate within the dimple 41 as shown in FIG. 5. With the substrate in position, a predetermined spacing between the lower flared end of electrode 22 is maintained by the support of the electrodes. When the electrolyte is admitted from the source 33 to flow in passage 32, the electrolyte flows into cores 15 and 20 through grooves 21. With a vacuum source on manifolds 37, the flow of electrolyte to the substrate 12 without collecting bubbles is aided.

With the electrolyte in the chamber, a constant current is applied to the terminals 23 to flow through the electrolyte into the substrate 12 which is grounded. After a time period of approximately one minute, the deposit of $AM^{241}$ hydroxide on the substrate is completed in the form as shown in FIG. 5. After the plating operation is completed, by the selected time period, the electrolyte is removed from chambers 15 and 20 by the proper rotation of the assembly either manually or automatically to drain the electrolyte. After the electrolyte is drained, an appropriate rinsing operation using a solution of alcohol is accomplished. To assist in removing the electrolyte, an air source is connected to manifolds 37 to pass air under pressure through the electrodes to aid in the flow of the electrolyte to receiver at 34. The rinsing with alcohol by connecting the source to manifolds 37 is followed by air drying by connecting an air source to the manifold.

Upon the lowering of member 11, substrate 12 is removed or moved along to place the substrate in a position to have empty dimples 41 under the chambers 15 and 20 for the plating operation of a radioactive source on another set of dimples of the substrate in the same manner as mentioned.

While the disclosure is shown for manual operation, the invention can be used with conventional automation wherein the control of the member 11, the control of electrolyte flow, the current flow timing, the control of draining, the control of rinsing and the control of drying operations would be programmed to occur with conventional control apparatus.

The invention should therefore be limited only by the scope of the appended claims wherein I claim:

1. In apparatus for electroplating a spot of radioactive material on a substrate comprising:

a member having at least one cavity which is open on one end, an electrode mounted in said cavity and positioned to have one end in the vicinity of said one end of said cavity, means for holding a substrate against said one end of said cavity and spaced a distance of approximately 50 to 100 thousandth of an inch from said electrode, a source of electrolyte connected to said cavity to fill said cavity with electrolyte, a source of electrical power, providing a constant current, and circuit means connecting one side of said source of power to said electrode and another side of said substrate whereby upon the flow of current through said electrolyte to said substrate a deposit of material forms on said substrate.

2. The invention of claim 1 wherein, said electrode is a tube with one flared end whereby said flared end is adjacent said substrate.

3. The invention of claim 2 comprising, means to remove said electrolyte from said cavity and to rinse said cavity, said means comprising air under pressure connected to said electrode tube to blow air into said one end of said cavity.

4. The invention of claim 1 wherein said substrate comprises a flat member with at least one dimple formed therein whereby said cavity can be placed adjacent said dimple to deposit material in said dimple.

5. The invention of claim 1 comprising, seal means surrounding said substrate to prevent loss of said electrolyte from said cavity.

6. The invention of claim 1 wherein said cavity has at least one vertical groove for said electrolyte to flow downward into said cavity.

7. The invention of claim 6 wherein said electrode is hollow and is connected to a vacuum source when electrolyte is being admitted to said cavity to reduce the formation of air bubbles in said cavity adjacent the substrate which would prevent the deposit of material on the substrate.

* * * * *